US010094590B2

(12) United States Patent
Chen

(10) Patent No.: US 10,094,590 B2
(45) Date of Patent: Oct. 9, 2018

(54) HEAT GUN HAVING IMPROVED FLOW EFFECTS

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 0 days.

(21) Appl. No.: 15/653,627

(22) Filed: Jul. 19, 2017

(65) Prior Publication Data

US 2018/0142919 A1 May 24, 2018

(30) Foreign Application Priority Data

Nov. 21, 2016 (TW) ..... 105138090 A

(51) Int. Cl.
*F24H 3/04* (2006.01)
*F24H 3/12* (2006.01)

(52) U.S. Cl.
CPC ..... *F24H 3/0423* (2013.01); *F24H 3/12* (2013.01)

(58) Field of Classification Search
CPC ..... F24H 3/0423; F24H 3/12
USPC ..... 34/187
See application file for complete search history.

(56) References Cited

U.S. PATENT DOCUMENTS 2,855,032 A 10/1958 Hahn
3,612,824 A * 10/1971 Berryman ..... F24H 3/0423 34/97
4,827,105 A * 5/1989 Brown, Jr. ..... A45D 20/12 219/222
5,057,008 A 10/1991 Dielissen
5,671,321 A * 9/1997 Bagnuolo ..... A45D 20/122 34/96
5,749,704 A * 5/1998 Jerdee ..... F04D 17/165 310/58
5,813,477 A 9/1998 Clay et al.
6,668,942 B1 12/2003 Lin
6,715,432 B2 4/2004 Tsumura et al.
9,146,042 B1 * 9/2015 Kurosu ..... B29C 35/045
9,173,468 B2 * 11/2015 Moloney ..... A45D 20/10
9,182,144 B2 11/2015 Chen
9,526,310 B2 * 12/2016 Courtney ..... A45D 20/12
9,808,066 B2 * 11/2017 Moloney ..... A45D 20/10
9,936,789 B2 * 4/2018 Stephens ..... A45D 20/122
(Continued)

FOREIGN PATENT DOCUMENTS

EP 0769656 A1 4/1997
EP 1201990 A1 5/2002
(Continued)

*Primary Examiner* — Stephen M Gravini
(74) *Attorney, Agent, or Firm* — Alan D. Kamrath; Kamrath IP Lawfirm, P.A.

(57) ABSTRACT

A heat gun includes a head portion. The head portion defines a flow passage having an inlet end at one end and an outlet end at another opposite end, and includes an inlet portion, an outlet portion and a flow guiding portion disposed between the inlet and outlet ends. The outlet portion is formed with two long sides and two short sides. The flow guiding portion is disposed between the inlet and outlet portions. The flow passage includes two flow guiding protrusions disposed at the flow guiding portion. The two flow guiding protrusions are disposed oppositely and extend oppositely along the long sides.

16 Claims, 12 Drawing Sheets

(56) References Cited

U.S. PATENT DOCUMENTS

| | | | |
|---|---|---|---|
| 2008/0263887 | A1 | 10/2008 | Nakasone et al. |
| 2013/0302019 | A1 | 11/2013 | Guillou et al. |
| 2014/0208996 | A1 | 7/2014 | Zhu et al. |
| 2014/0219643 | A1 | 8/2014 | Ma et al. |
| 2015/0335128 | A1 | 11/2015 | Larken et al. |

FOREIGN PATENT DOCUMENTS

| | | | | | |
|---|---|---|---|---|---|
| EP | 1795803 | A2 | | 6/2007 | |
| FR | 2520090 | A1 | | 7/1983 | |
| GB | 2030280 | A | | 4/1980 | |
| GB | 2533323 | A | * | 6/2016 | ..... A45D 20/10 |
| WO | 94/23611 | A | | 10/1994 | |
| WO | WO 2016097682 | A1 | * | 6/2016 | ..... A45D 20/10 |

* cited by examiner

HEAT GUN HAVING IMPROVED FLOW EFFECTS

BACKGROUND OF THE INVENTION

1. Field of the Invention

The present invention relates to a heat gun and, particularly, to a heat gun having improved flow effects.

2. Description of the Related Art

EP 1795803 A2 shows a modular gas burning hand tool including a main body, an ignite gas pipe for circulating gas defined by the main body which extends longitudinally, a grip handle, and a burner part including a hollow body extending from the main body and communicating with the ignite gas pipe and including a gas-powered unit disposed at an end of the hollow body. The burner part has a junction part, the main body has a junction part, and the junction parts are adapted to be releasably secured to one another.

It is known for gas heat guns to use high pressure gas and to incorporate venturi tubes to mix gas. The high pressure gas is spewed at a high velocity out of a gas nozzle in the venturi tube, which causes outside air to flow to the venturi tube and a chamber from which a flame exits to achieve an appropriate ratio of gas mixture and to increase the amount of the gas mixture. Furthermore, the venturi tube includes an opposite end nconnecting to a mixing chamber. Moreover, the mixing chamber is shrouded by a flow-rectifying cover that is configured to control the flow speed and distributability of the gas mixture as well as preventing the backward propagation of the flame.

An ideal high power gas heat gun is required to provide a high speed flame. In this regard, a user can aim the gas heat gun at a target to be heated easily. Moreover, the greater the width of a flame exit end of the gas heat gun, the easier the user can operate the gas heat gun to heat the target precisely and to heat large areas quickly. However, conventional high power gas heat guns suffer problems, including:

1. A flame flowing out of the flame exit end is not evenly distributed and therefore doesn't apply heat to a surface evenly.

2. Mixing and dispensing gas unevenly result in poor combustion, which not only reduces efficiency and wastes gas, but which also produce too much noxious carbon monoxide (CO) and nitrogen oxide (NOx).

3. The temperature of the flame exit end is very high, and a large amount of heat is concentrated. Furthermore, heat radiates and conducts. The chamber, which includes the flame exit end, is hot and often reaches a temperature above 100 degrees Centigrade. Therefore, there is a high risk that the user gets burned inadvertently.

4. The flow-rectifying cover has an exit being too small, which results in substantial pressure losses, a flow capacity decrease overall, and a difficulty to increase heat power.

5. High pressure gas and the gas mixture create turbulence in the mixing chamber and the flow-rectifying cover and result in a noise.

6. Rectifying flows unduly cause the flame at the flame exit end to flow at a low speed. Since the flame spreads linearly mostly, if the flame flows at a speed which is too low, the flame is susceptible to distortion under thermal buoyant effects. Thus, it is difficult to aim the gas heat gun at the target precisely. The flame is also easily affected by air currents when the gas heat gun is used in an outside environment. Thus, it is difficult to operate and aim the gas heat gun at the target precisely in a wind environment and especially if the wind varies directions. Furthermore, when the flame moves against the wind, the flame, which flows too slow, may burn backward toward the user.

7. If gas is mixed and dispensed unsteadily, a suitable pressure range for supplying gas becomes limited, and the chance to ignite the gas is substantially reduced.

The conventional mixing chamber is fan-shaped and varies regularly in cross section along a center axis of the venturi tube. In order to speed up operations, it is necessary that areas that can be heated instantaneously and that heat power are increased. Thus, an exit of the mixing chamber which has a narrow width is not desired. Increasing the width of the exit of the mixing chamber, however, makes it more difficult to control flows at the exit at the same speed. In fact, flows at two sides of the exit flow faster, and flows in the middle of the exit flow slower (see FIG. 12). If reducing the width of the exit of the mixing chamber, areas that can be heated are smaller. If increasing heat power, heat concentrates in a small region and results in local overheating. If increasing a distance between the gas heat gun and the target, thermal buoyant force and air flow disturbance make it difficult for the user to aim the gas heat gun at areas to be heated. Therefore, a high power gas heat gun that allows a user to heat a target precisely and evenly includes a wide flame exit and a flame that exits at high speed.

In addition to flow noise and the phenomenon that the temperature at the two sides are higher, the flame is nearly transparent. Therefore, it is hard to perceive the direction of heat transfer. This causes the user to have a poor aim of the target and where the gas heat gun aims is not exactly where the user wants to heat. Furthermore, since the flows are not at the same speed, an increase of heat capacity results in incomplete combustions at the two sides, and trying to use flow guides to control flows, however, imposes frictional forces on the flows and reduces overall flow capacity and efficiency.

Since a large amount of heat is concentrated at the flame exit end, the temperature is very high, due to heat radiation and conduction, and is often above 100 Centigrade. Therefore, there is a high risk that the user gets burned inadvertently. After the flame stops, it also takes quite a while to dissipate heat and cool the temperature down with respect to the ambient temperature, and since the user doesn't know when the gas heat gun has cooled, it is easy that he or she can get burned inadvertently.

FIG. 11 is a partial, cross-sectional view of a conventional gas heat gun. As set forth, the gas heat gun includes a device 11' from which gas burns. The device 11' includes a net and a main body defining a tube in circular cross-section. When gas flows in the tube, it flows faster in the center of the tube than at the edges of the tube. The gas will flow out of tube and into a burner part 9'. Likewise, the gas flows faster in the center of the burner part 9' than at edges of the burner part 9'. The gas in the burner part 9' will contact the device 11'. The device 11' will obstruct and deflect the gas. FIG. 11 shows that after the gas is obstructed by the device 11', it is partially deflected and flows toward two sides of the burner part 9' in opposing directions. Consequently, flow capacity at the two sides of the burner part 9' is more, and flow capacity in the middle of the burner part 9' is lesser. As a result, the temperature at the two sides is higher than the temperature in the middle, and the gas heat gun does not give out even heat and uniform temperature. Furthermore, the temperature of the burner part 9' is very hot, but the user can't tell by appearance. Therefore, it is easy that he or she can get burned inadvertently.

The present invention is, therefore, intended to obviate or at least alleviate the problems encountered in the prior art.

SUMMARY OF THE INVENTION

According to the present invention, a heat gun having improved flow effects includes a head portion. The head portion defines a flow passage. The flow passage extends longitudinally along an axis, has an inlet end at one end and an outlet end at another opposite end, and includes an inlet portion, an outlet portion and a flow guiding portion disposed between the inlet and outlet ends. The outlet portion is formed with two long sides and two short sides, with the two long sides opposite one another, and with the two short sides opposite one another. The flow guiding portion is disposed between the inlet and outlet portions. The flow passage includes two flow guiding protrusions disposed at the flow guiding portion. The two flow guiding protrusions are disposed oppositely. The two flow guiding protrusions extend oppositely along the long sides.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
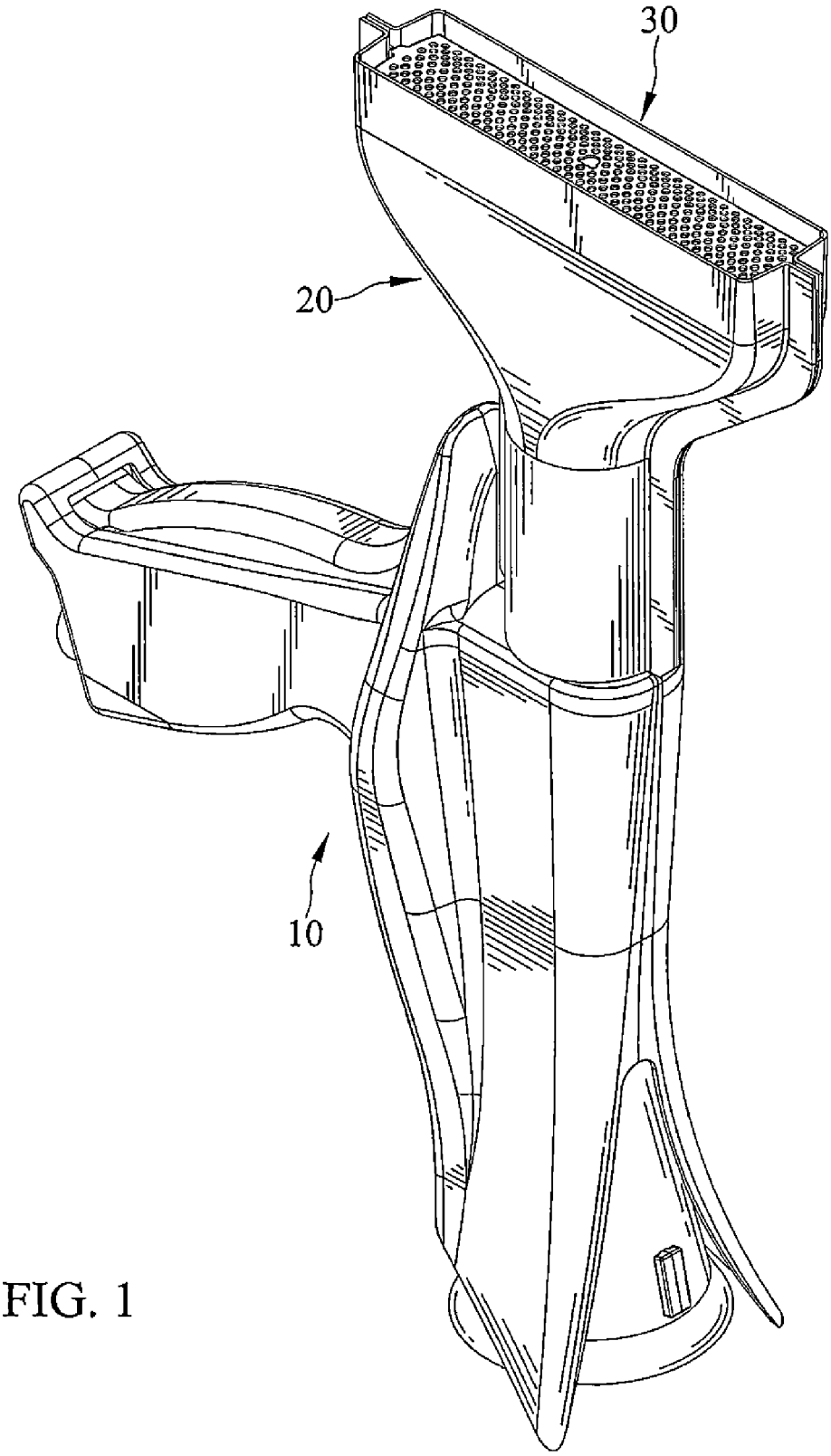
FIG. 1 is a perspective view of a heat gun having improved flow effects in accordance with the present invention.
Figure 2:
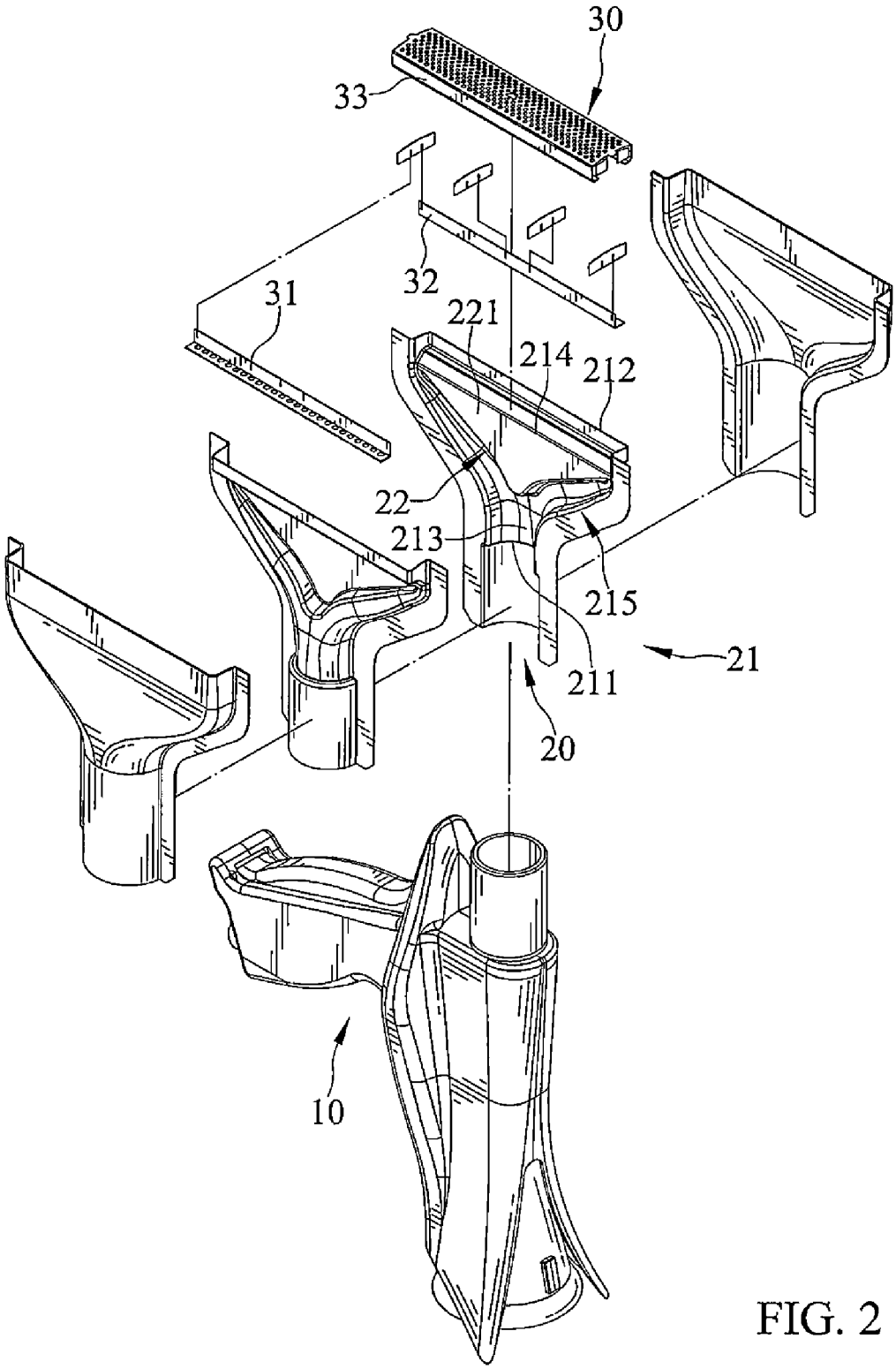
FIG. 2 is an exploded perspective view of a head portion of the heat gun of the present invention.
Figure 3:
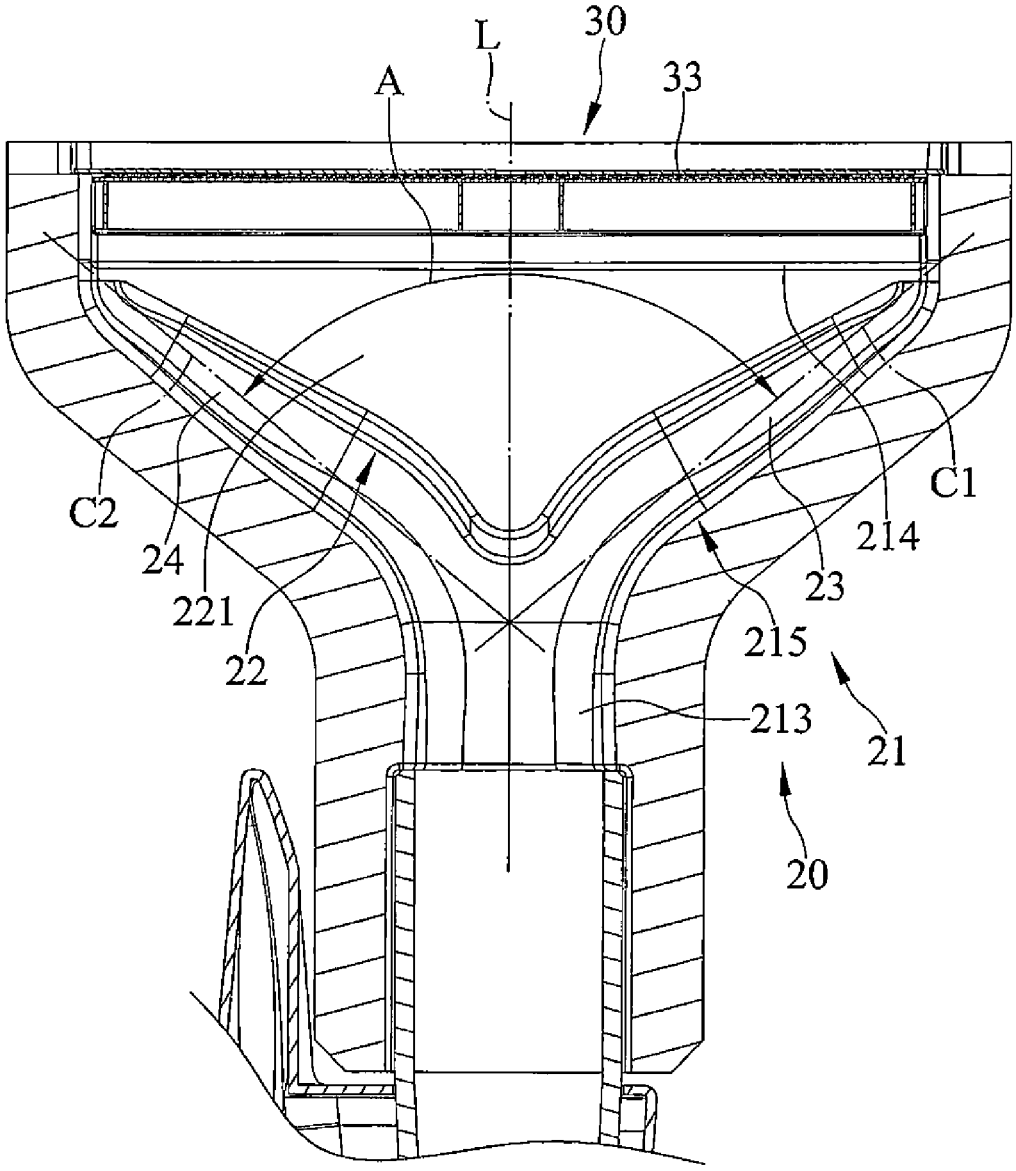
FIG. 3 is a cross-sectional view of the head portion of the heat gun of the present invention.
Figure 4:
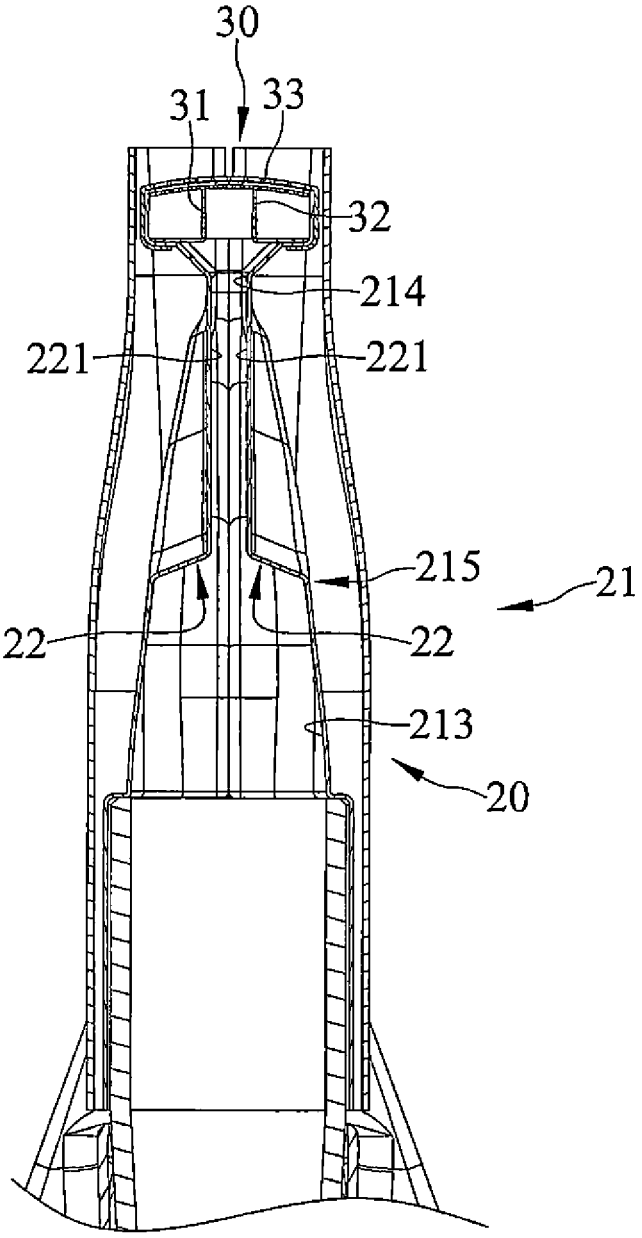
FIG. 4 is another cross-sectional view of the head portion of the heat gun of the present invention.
Figure 5:
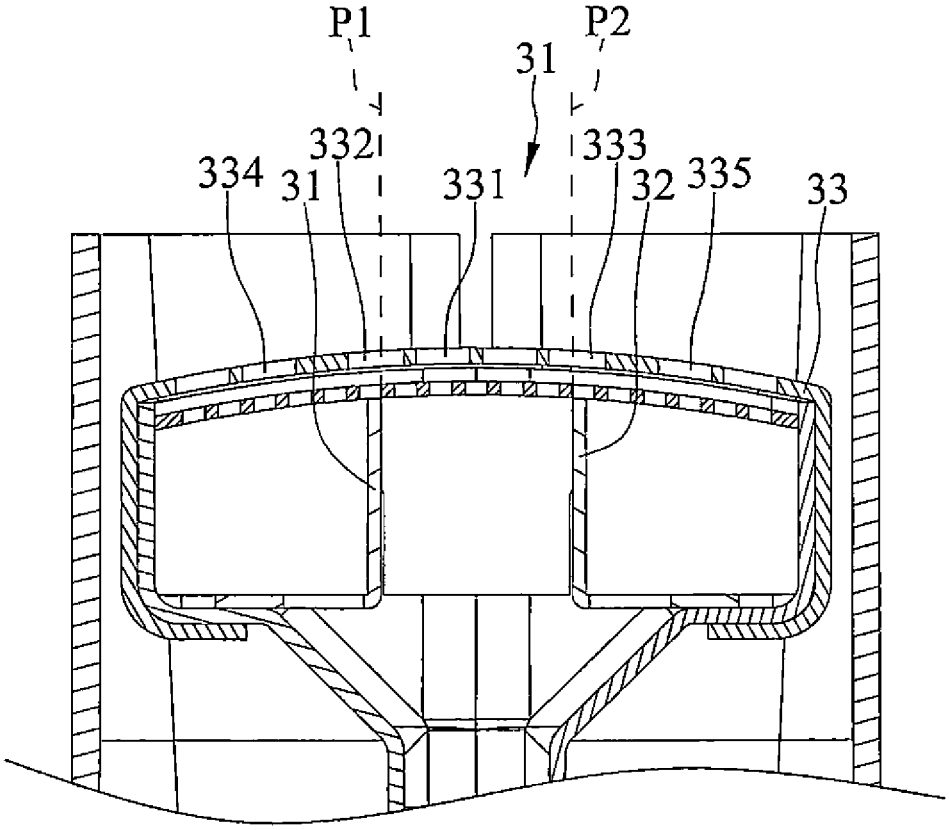
FIG. 5 is a partial, enlarged view of FIG. 4.
Figure 6:
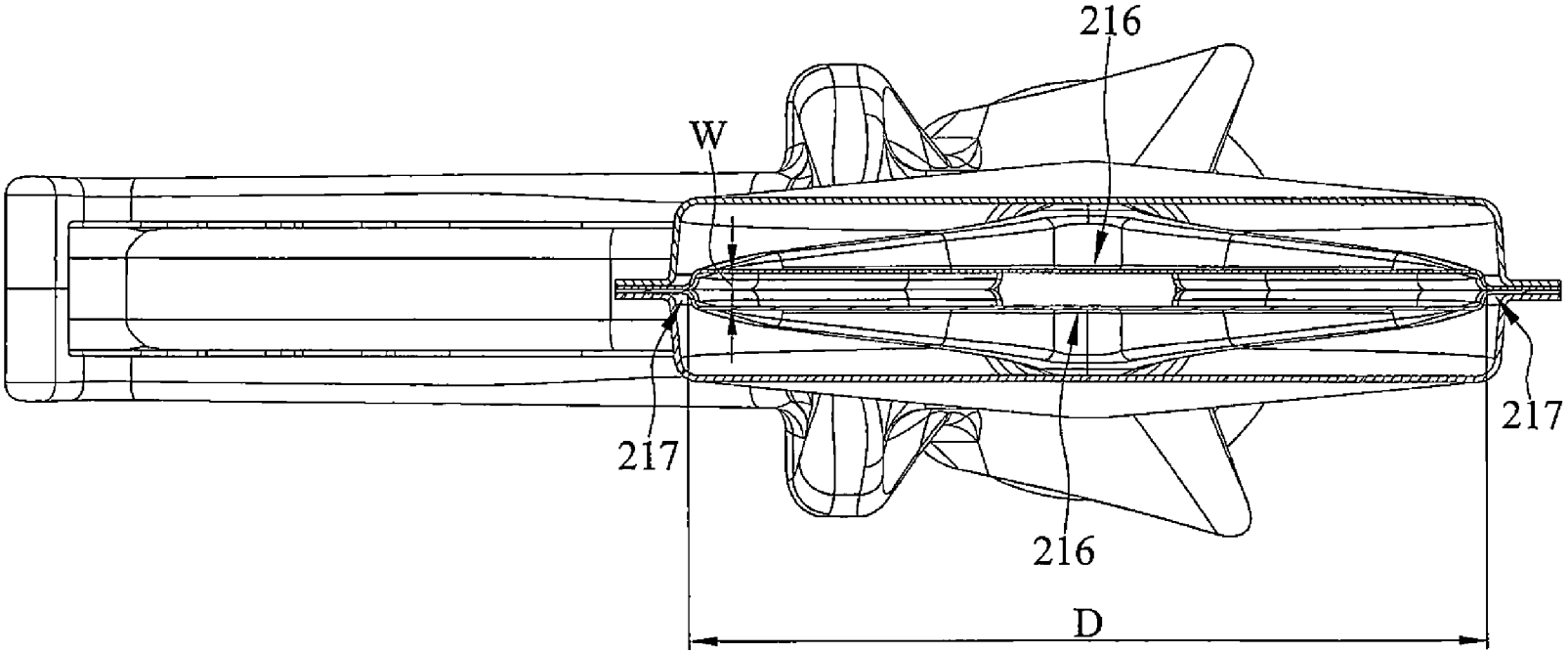
FIG. 6 is a cross-sectional view of the heat gun of the present invention, taken from a line extending transversely to an axis L that is shown in FIG. 3.
Figure 7:
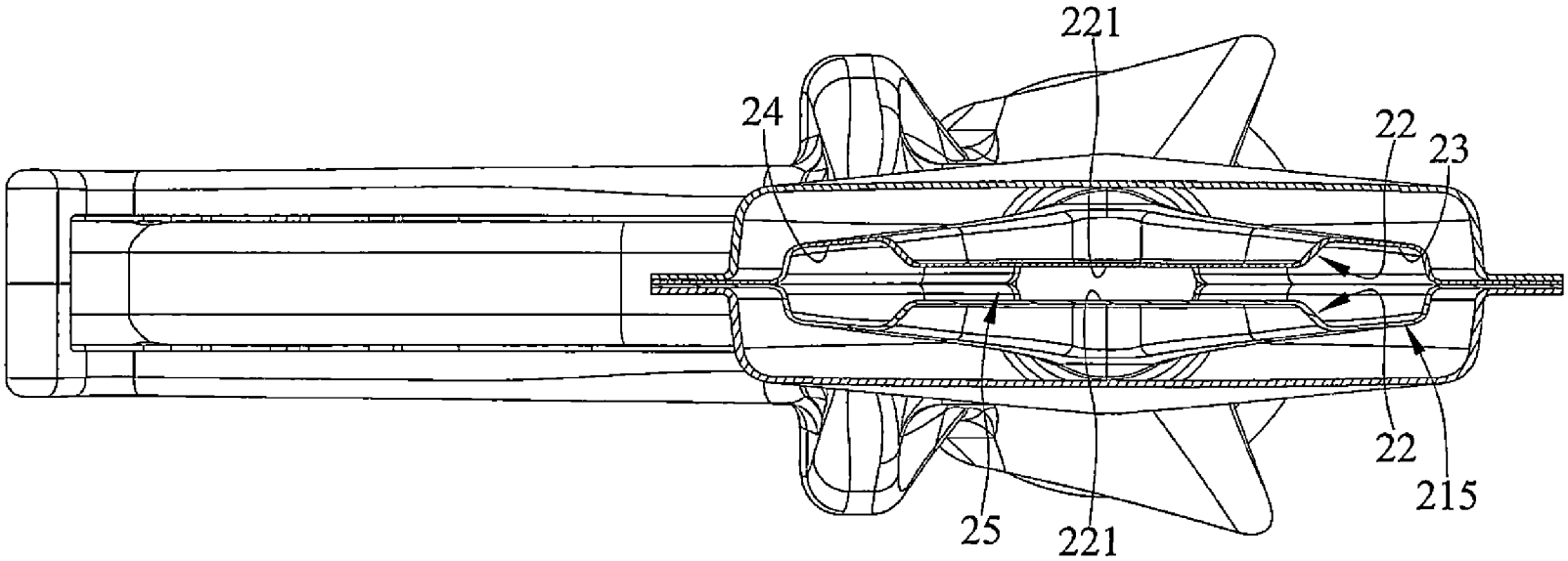
FIG. 7 is a cross-sectional view of the heat gun of the present invention, taken from another line extending transversely to the axis L that is shown in FIG. 3.
Figure 8:
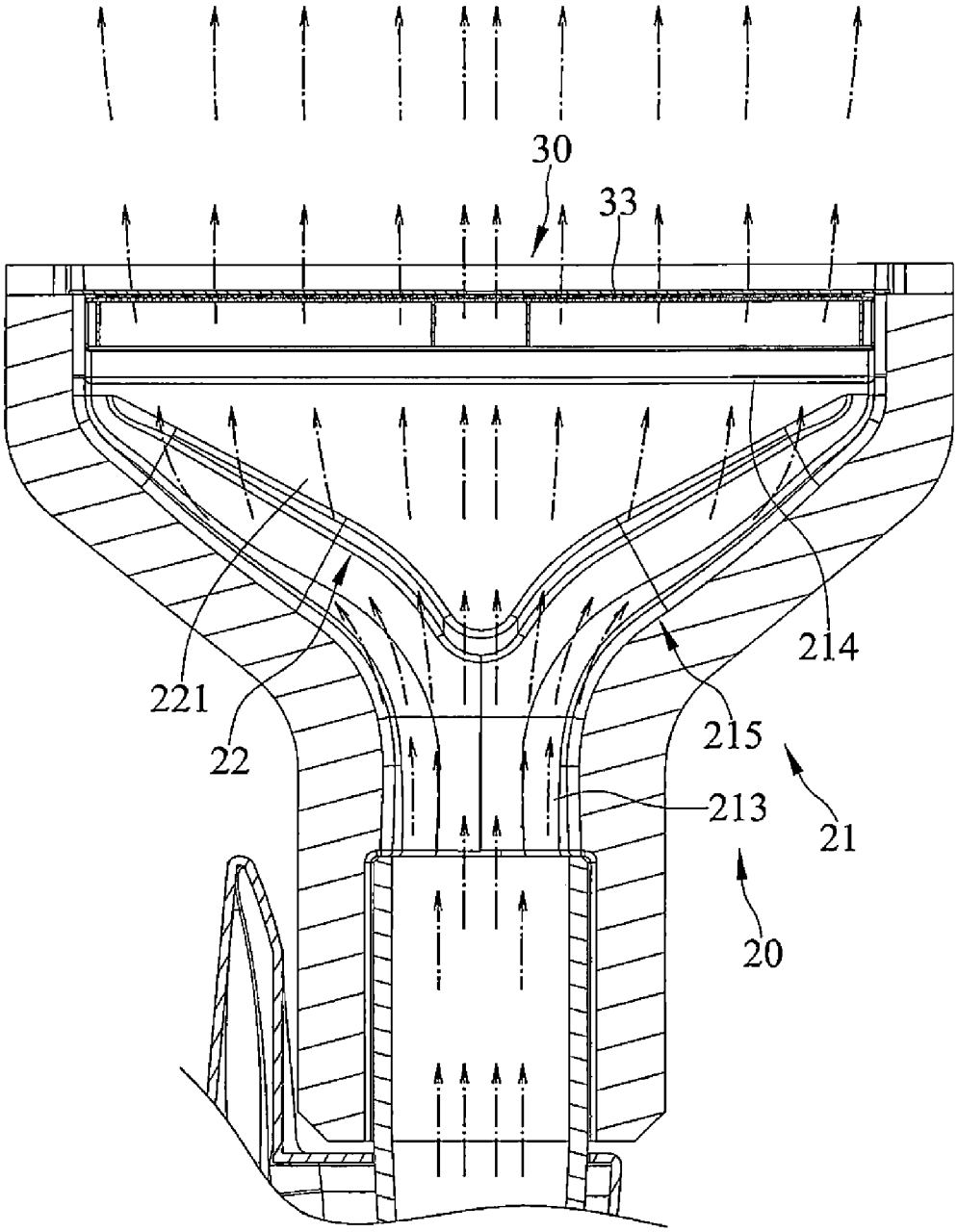
FIG. 8 is a cross-sectional view illustrating the heat gun of the present invention in operation, with arrows indicating flows.
Figure 9:
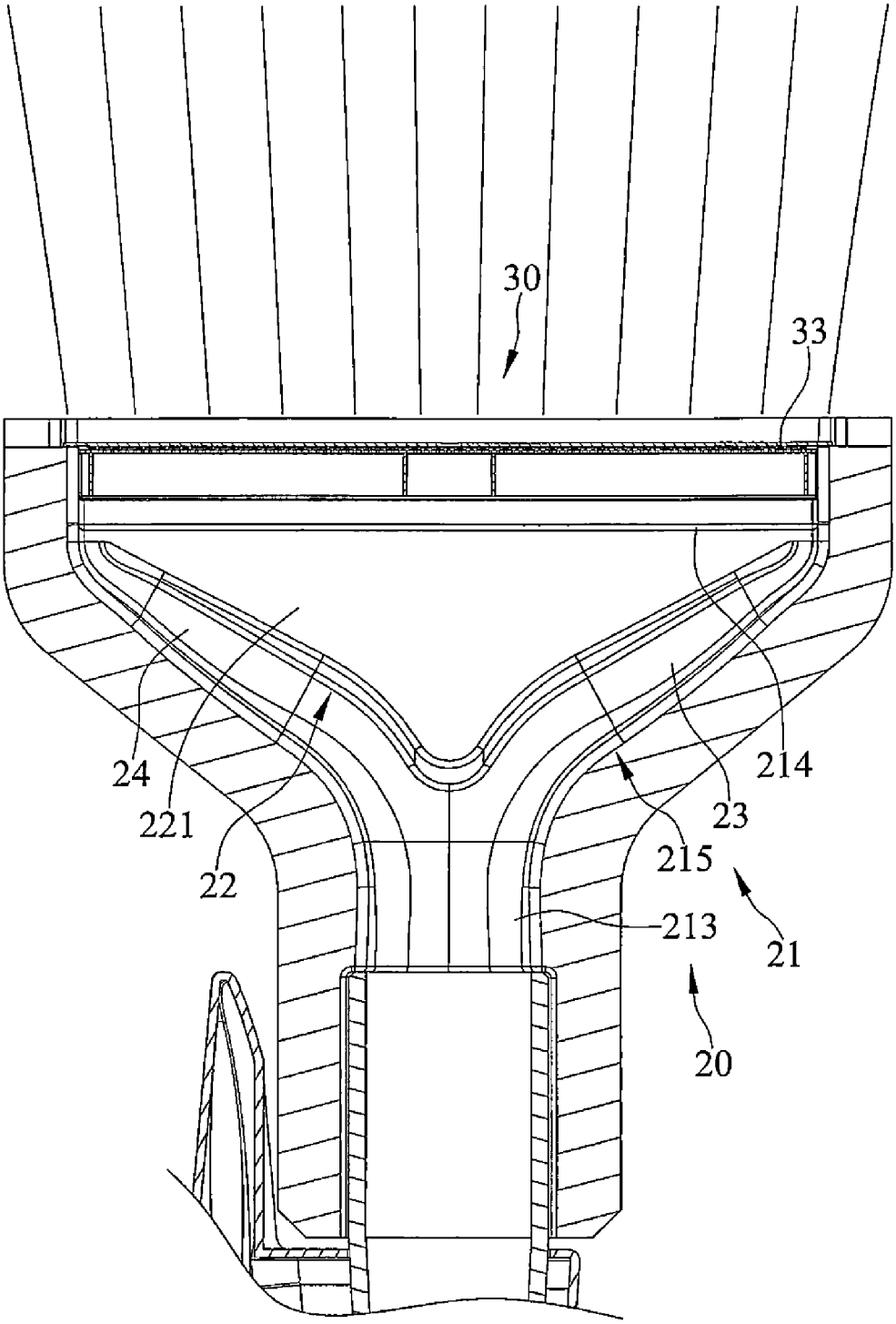
FIG. 9 is another cross-sectional view illustrating the heat gun of the present invention in operation, with solid lines illustrating heat.
Figure 10:
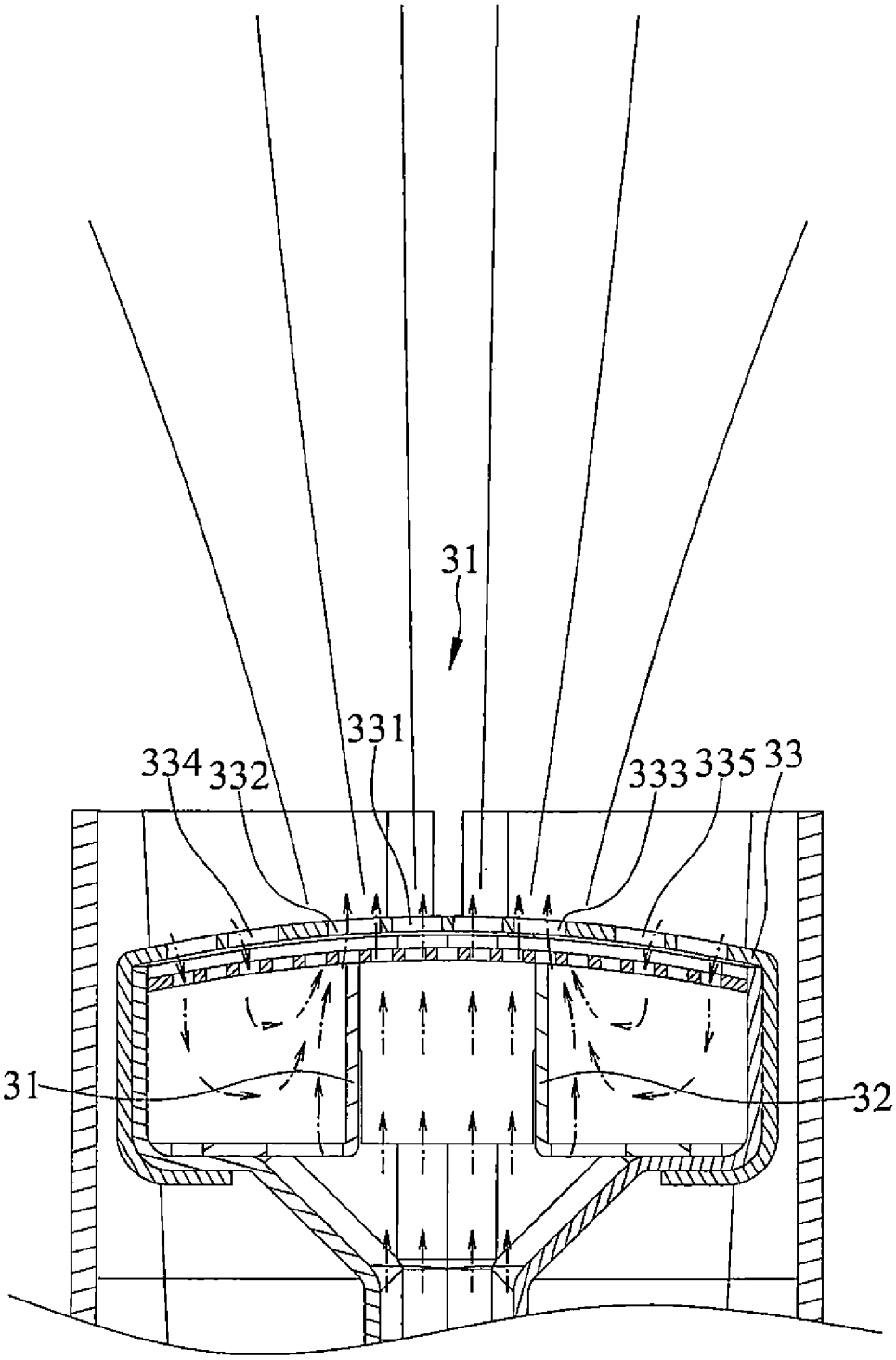
FIG. 10 is another cross-sectional view illustrating the heat gun of the present invention, with solid lines illustrating heat.
Figure 11:
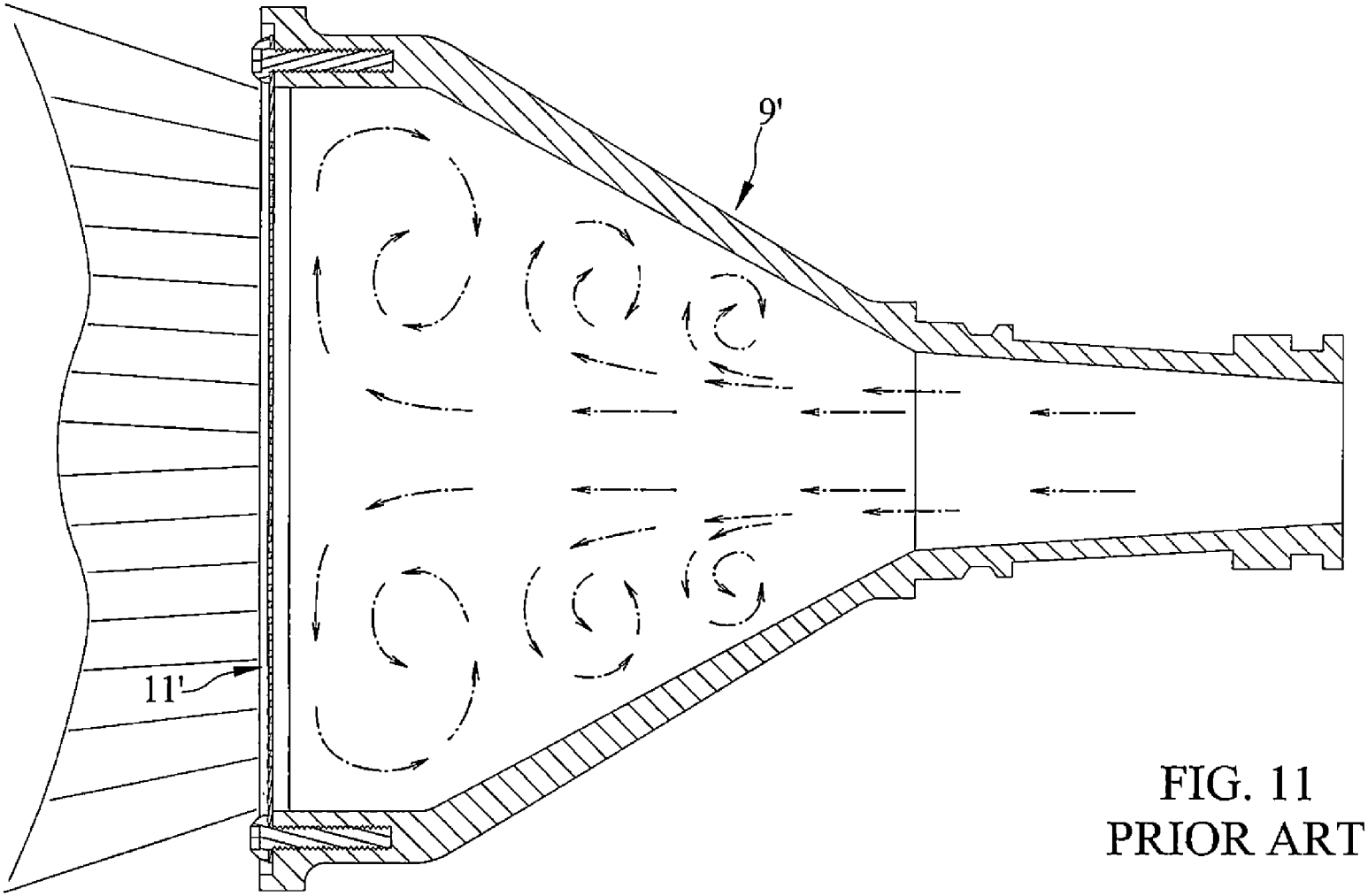
FIG. 11 PRIOR ART
FIG. 11 is a cross-sectional view of a conventional heat gun.
Figure 12:
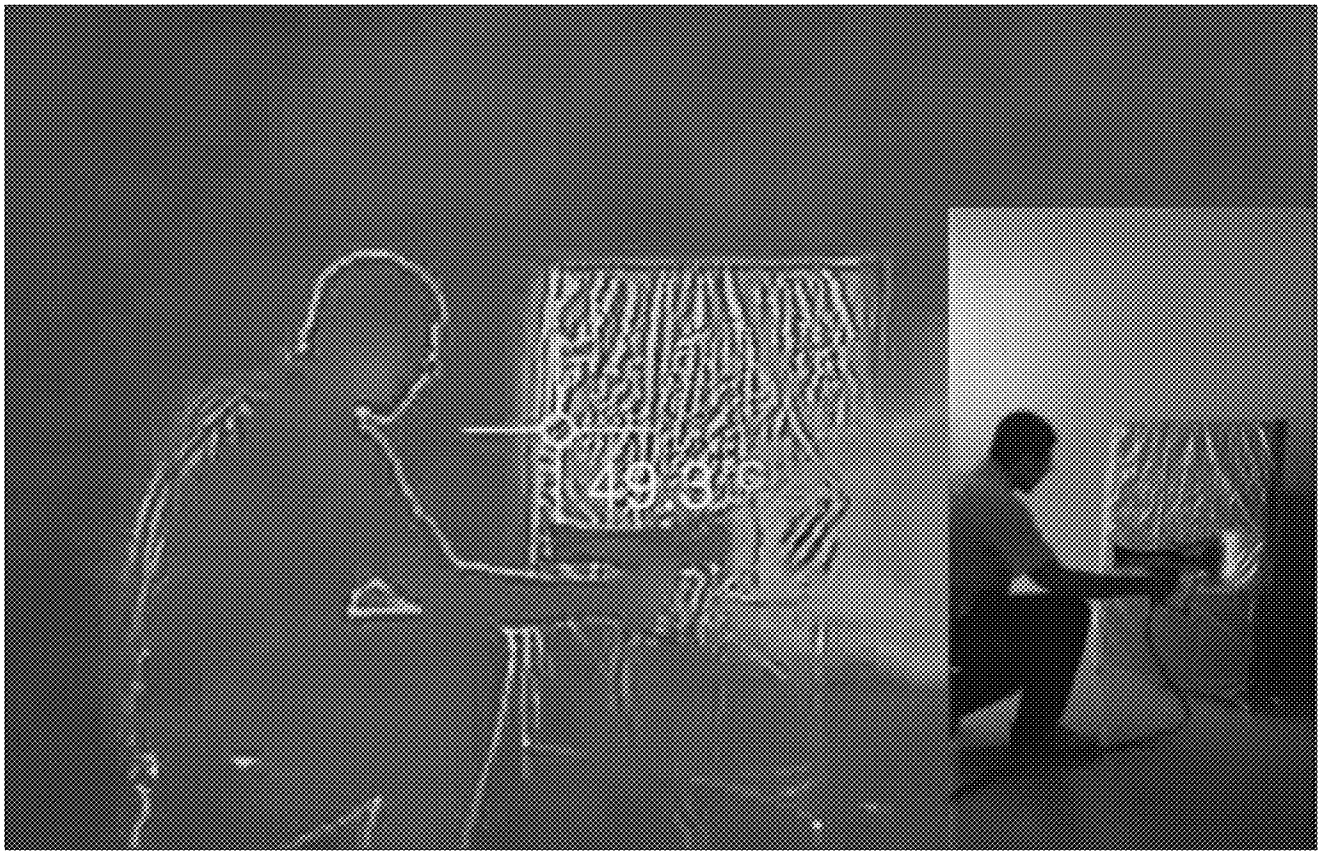
FIG. 12 is a thermal image of conventional heat gun in operation.

FIGS. 1 through 10 show a heat gun 10 having improved flow effects in accordance with the present invention.

The heat gun 10 includes a head portion 20.

The head portion 20 defines a flow passage 21. The flow passage21 extends longitudinally along an axis L. The flow passage 21 has an inlet end 211 at one end and an outlet end 212 at another opposite end. The flow passage 21 includes an inlet portion 213, an outlet portion 214 and a flow guiding portion 215 disposed between the inlet and outlet ends 211 and 212.

The flow passage 21 includes two flow guiding protrusions 22 disposed at the flow guiding portion 215. The flow guiding protrusions 22 include two outer peripheries facing oppositely and converging toward one another in a direction from the outlet portion 214 to the inlet portion 213. Each of the two outer peripheries of the two flow guiding protrusions 22 has a nonplanar contour. The two flow guiding protrusions 22 are disposed oppositely. The two flow guiding protrusions 22 extend oppositely along the long sides 216.

The head portion 20 includes two surfaces 221 disposed oppositely, and the two flow guiding protrusions 22 protrude between the two surfaces 221. The two surfaces 221 are disposed parallel to one another, or otherwise, incline from each other such that an included angle formed therebetween is greater than 0 degrees and less than 10 degrees. When the two surfaces 221 are inclined, a distance between ends of the two surfaces 221 which are adjacent to the inlet portion 213 is greater than a distance between ends of the two surfaces 221 which are adjacent to the outlet portion 214.

The inlet portion 213 has a radial cross-sectional area about the axis L. The outlet portion 214 has a radial cross-sectional area about the axis L and which is greater than 0.8 times and smaller than 1.2 times of the radial cross-sectional area of the inlet portion 213. The radial cross-sectional area of the inlet portion 213 is circular in shape. The radial cross-sectional area of the outlet portion 214 is quadrilateral in shape.

The outlet portion 214 is formed with two long sides 216 and two short sides 217. The two long sides 216 are opposite one another. The long side 216 extends lengthwise of the outlet portion 214 and in a direction transverse to the axis L for a length D. The two short sides 217 are opposite one another. The two short sides 217 extend between the two long sides 216. The short side 217 extends widthwise of the outlet portion 214 and in a direction transverse to the axis L for a width W. The length D is greater than a maximum width of the inlet end 211. The maximum width of the inlet end 211 extends in the lengthwise direction of the outlet portion 214. The width W is smaller than the maximum width of the inlet end 211. In addition, the two surfaces 221 are spaced at a distance greater than or equal to the width W.

The flow guiding portion 215 is disposed between the inlet and outlet portions 213 and 214. The flow guiding portion 215 is partitioned by the two flow guiding protrusions 22 and defines a first flow region 23 which extends along a first extension axis C1, a second flow region 24 which extends along a second extension axis C2 and a third flow region 25. The first and second extension axes C1 and C2 are disposed symmetrically about the axis L. The first extension axis C1 intersects the second extension axis C2 at an included angle A greater than 60 degrees and smaller than 160 degrees. The third flow region 25 is disposed between the two flow guiding protrusions 22. The first and third flow regions 23 and 25 are disposed on opposite sides of one of the two flow guiding protrusions 22. The second and third flow regions 24 and 25 are disposed on opposite sides of another of the two flow guiding protrusions 22. The third flow region 25 includes a side connected to the first flow region 23 and an opposite side connected to the second flow region 24. The first flow region 23 extends from a first end which is adjacent to the inlet portion 213 to a second end which is adjacent to the outlet portion 214 and has a gradually reduced cross-section from the first end to the second end.

The first flow region 23 has a middle portion which is in the middle between the inlet portion 213 and the outlet portion 214 and which has a radial cross-section about the first extension axis C1 greater than 0.25 times and smaller than 0.4 times of a radial cross-section of the inlet portion 213 about the axis L. The second flow region 24 extends from a first end which is adjacent to the inlet portion 213 to a second end which is adjacent to the outlet portion 214 and has a gradually reduced cross-section from the first end to the second end. The second flow region 24 has a middle portion which is in the middle between the inlet portion 213 and the outlet portion 214 and which has a radial cross-section about the second extension axis C2 greater than 0.25 times and smaller than 0.4 times of the radial cross-section of the inlet portion 213.

Furthermore, the first flow region 23 has a maximum radial cross-sectional area about the first extension axis C1 which is ⅓ of a maximum radial cross-sectional area of the inlet portion 213 about the axis L. The second flow region 24 has a maximum radial cross-sectional area about the second extension axis C2 which is ⅓ of the maximum radial cross-sectional area of the inlet portion 213 about the axis L. The first flow region 23 has a minimum radial width about the first extension axis C1 greater than a minimum radial cross-section of the third flow region 25 about the axis L. The second flow region 24 has a minimum radial width about the second extension axis C2 greater than the minimum radial width of the third flow region 25 about the axis L.

The head portion 20 is configured to cooperate with a windshield 30 to improve flow effects. The windshield 30 is disposed at the outlet end 212 of the flow passage 21. The windshield 30 includes first and second partitions 31 and 32 and a shield 33. The first and second partitions 31 and 32 are disposed in a spaced relationship. The first and second partitions 31 and 32 each extends parallel to the axis L from an end adjacent to the outlet portion 214 to another end. The first and second partitions 31 and 32 are disposed parallel to the long sides 216. A distance between the first and second partitions 31 and 32 is greater than the width W.

The shield 33 extends transversely to the axis L and is disposed adjacent to another end of the first and second partitions 31 and 32. The shield 33 includes first, second, third, fourth, and fifth through holes 331, 332, 333, 334, and 335. The first through hole 331 is located between first and second phantom lines P1 and P2 which align inner sides of the first and second partitions 31 and 32 which face oppositely. The second through hole 332 includes a portion located on a right side of the first phantom line P1 and a portion located on a left side of the first phantom line P1. The third through hole 333 includes a portion located on a right side of the second phantom line P2 and a portion located on a left side of the second phantom line P2. The fourth and fifth through holes 334 and 335 are located outside the first and second phantom lines P1 and P2. The fourth through hole 334 is located on the left side of the first phantom line P1. The fifth through hole 335 is located on the right side of the second phantom line P2.

In view of the forgoing, the design of the head portion 20 greatly reduces the likelihood that flows flow backward and turbulence, thereby improving combustion efficiency, as well as lowering noise and preventing pressure drops. Furthermore, the head portion 20 allows higher flow capacity when compared with conventional head portion designs and others heat to distribute evenly with a greater pressure range. Consequently, heating conditions can be easily controlled. Even if the pressure varies, the chance to ignite the gas is not affected.

The foregoing is merely illustrative of the principles of this invention, and various modifications can be made by those skilled in the art without departing from the scope and spirit of the invention.

What is claimed is:

1. A heat gun having improved flow effects, includes a head portion, comprising:

the head portion defining a flow passage, wherein the flow passage extends longitudinally along an axis, has an inlet end at one end and an outlet end at another opposite end, and includes an inlet portion, an outlet portion and a flow guiding portion disposed in the flow passage between the inlet and outlet ends, wherein the outlet portion is formed with two long sides and two short sides, with the two long sides opposite one another, with the two short sides opposite one another, wherein the flow guiding portion is disposed between the inlet and outlet portions, wherein the flow passage includes two flow guiding protrusions disposed at the flow guiding portion, wherein the two flow guiding protrusions are disposed oppositely, and wherein the two flow guiding protrusions extend oppositely in a direction transverse to the axis away from each other and from a position adjacent to the inlet portion to a position adjacent to the outlet portion along the two long sides.

2. The heat gun as claimed in claim 1 wherein the flow guiding portion is partitioned by the two flow guiding protrusions and defines a first flow region which extends along a first extension axis, a second flow region which extends along a second extension axis and a third flow region, wherein the third flow region is disposed between the two flow guiding protrusions, wherein the first and third flow region are disposed on opposite sides of one of the two flow guiding protrusions, wherein the second and third flow regions are disposed on opposite sides of another of the two flow guiding protrusions, wherein the third flow region includes a side connected to the first flow region and an opposite side connected to the second flow region, wherein the first flow region extends from a first end which is adjacent to the inlet portion to a second end which is adjacent to the outlet portion and has a gradually reduced cross-section from the first end to the second end, wherein the first flow region has a middle portion which is in the middle between the inlet portion and the outlet portion and which has a radial cross-section about the first extension axis greater than 0.25 times and smaller than 0.4 times of a radial cross-section of the inlet portion about the axis, wherein the second flow region extends from a first end which is adjacent to the inlet portion to a second end which is adjacent to the outlet portion and has a gradually reduced cross-section from the first end to the second end, and wherein the second flow region has a middle portion which is in the middle between the inlet portion and the outlet portion and which has a radial cross-section about the second extension axis greater than 0.25 times and smaller than 0.4 times of the radial cross-section of the inlet portion.

3. The heat gun as claimed in claim 2, wherein the first flow region has a maximum radial cross-sectional area about the first extension axis which is ⅓ of a maximum radial cross-sectional area of the inlet portion about the axis, and wherein the second flow region has a maximum radial cross-sectional area about the second extension axis which is ⅓ of the maximum radial cross-sectional area of the inlet portion about the axis.

4. The heat gun as claimed in claim 2, wherein the first flow region has a minimum radial width about the first extension axis greater than a minimum radial cross-section of the third flow region about the axis, and wherein the second flow region has a minimum radial width about the second extension axis greater than the minimum radial width of the third flow region about the axis.

5. The heat gun as claimed in claim 4, wherein the two flow guiding protrusions include two outer peripheries facing oppositely and converging toward one another in a direction from the outlet portion to the inlet portion.

6. The heat gun as claimed in claim 5, wherein the first and second extension axes are disposed symmetrically about the axis, and wherein the first extension axis intersects the second extension axis at an included angle greater than 60 degrees and smaller than 160 degrees.

7. The heat gun as claimed in claim 6, wherein the head portion includes a windshield disposed at the outlet end of the flow passage, wherein the windshield includes first and second partitions and a shield, wherein the first and second partitions each extend parallel to the axis from an end adjacent to the outlet portion to another end, wherein the first and second partitions are disposed parallel to the two long sides, wherein the shield extends transversely to the axis and is disposed adjacent to other ends of the first and second partitions, and wherein the shield includes first, second, and third through holes, with the first through hole located between first and second phantom lines which align with inner sides of the first and second partitions which face oppositely, with the second through hole including a portion located on a right side of the first phantom line and a portion located on a left side of the first phantom line, and with the third through hole including a portion located on a right side of the second phantom line and a portion located on a left side of the second phantom line.

8. The heat gun as claimed in claim 7, wherein the shield includes fourth and fifth through holes, with the fourth and fifth through holes located outside the first and second phantom lines, with the fourth through hole located on the left side of the first phantom line, and with the fifth through hole located on the right side of the second phantom line.

9. The heat gun as claimed in claim 7, wherein each long side extends lengthwise of the outlet portion and in a direction transverse to the axis for a length, wherein each short side extends widthwise of the outlet portion and in the direction transverse to the axis for a width, wherein the length is greater than a maximum width of the inlet end, wherein the width is smaller than the maximum width of the inlet end, and wherein a distance between the first and second partitions is greater than the width.

10. The heat gun as claimed in claim 8, wherein the head portion includes two surfaces disposed oppositely, wherein the two flow guiding protrusions protrude between the two surfaces, and wherein the two surfaces are spaced at a distance greater than or equal to the width.

11. The heat gun as claimed in claim 10, wherein the two surfaces are disposed parallel to one another.

12. The heat gun as claimed in claim 10, wherein the two surfaces are inclined from each other such that an included angle formed therebetween is greater than 0 degrees and less than 10 degrees, and wherein a distance between ends of the two surfaces which are adjacent to the inlet portion is greater than a distance between ends of the two surfaces which are adjacent to the outlet portion.

13. The heat gun as claimed in claim 12, wherein the outlet portion has a first radial cross-sectional area about the axis and the inlet portion has a second radial cross-sectional area about the axis respectively, and wherein the first radial cross-sectional area is greater than 0.8 times and smaller than 1.2 times of the second radial cross-sectional area.

14. The heat gun as claimed in claim 13, wherein the first radial cross-sectional area is equal to the second radial cross-sectional area.

15. The heat gun as claimed in claim 13, wherein the first radial cross-sectional area is circular in shape, and wherein the second radial cross-sectional area is quadrilateral in shape.

16. A heat gun having improved flow effects, includes a head portion, comprising:

the head portion defining a flow passage, wherein the flow passage extends longitudinally along an axis, has an inlet end at one end and an outlet end at another opposite end, and includes an inlet portion, an outlet portion and a flow guiding portion disposed between the inlet and outlet ends, wherein the outlet portion is formed with two long sides and two short sides, with the two long sides opposite one another, with the two short sides opposite one another, wherein the flow guiding portion is disposed between the inlet and outlet portions, wherein the flow passage includes two flow guiding protrusions disposed at the flow guiding portion, wherein the two flow guiding protrusions are disposed oppositely, wherein the two flow guiding protrusions extend oppositely in a length direction of the two long sides, wherein the flow guiding portion is partitioned by the two flow guiding protrusions and defines a first flow region which extends along a first extension axis, a second flow region which extends along a second extension axis and a third flow region, wherein the third flow region is disposed between the two flow guiding protrusions, wherein the first and third flow region are disposed on opposite sides of one of the two flow guiding protrusions, wherein the second and third flow regions are disposed on opposite sides of another of the two flow guiding protrusions, wherein the third flow region includes a side connected to the first flow region and an opposite side connected to the second flow region, wherein the first flow region extends from a first end which is adjacent to the inlet portion to a second end which is adjacent to the outlet portion and has a gradually reduced cross-section from the first end to the second end, wherein the first flow region has a middle portion which is in the middle between the inlet portion and the outlet portion and which has a radial cross-section about the first extension axis greater than 0.25 times and smaller than 0.4 times of a radial cross-section of the inlet portion about the axis, wherein the second flow region extends from a first end which is adjacent to the inlet portion to a second end which is adjacent to the outlet portion and has a gradually reduced cross-section from the first end to the second end, and wherein the second flow region has a middle portion which is in the middle between the inlet portion and the outlet portion and which has a radial cross-section about the second extension axis greater than 0.25 times and smaller than 0.4 times of the radial cross-section of the inlet portion.

* * * * *